US007729633B2

(12) United States Patent
Bildstein et al.

(10) Patent No.: US 7,729,633 B2
(45) Date of Patent: Jun. 1, 2010

(54) PRINTER DYNAMICALLY MONITORING PRINTER ENVIRONMENT CONTAMINATION

(75) Inventors: Carl R. Bildstein, Superior, CO (US); Timothy Bradley, Longmont, CO (US); Bradford Brooks, Longmont, CO (US); Larry M. Ernst, Longmont, CO (US); Joan L. Mitchell, Longmont, CO (US)

(73) Assignee: InfoPrint Solutions Company, LLC, Boulder, CO (US)

( * ) Notice: Subject to any disclaimer, the term of this patent is extended or adjusted under 35 U.S.C. 154(b) by 665 days.

(21) Appl. No.: 11/622,612

(22) Filed: Jan. 12, 2007

(65) Prior Publication Data

US 2008/0170877 A1 Jul. 17, 2008

(51) Int. Cl.
*G03G 21/00* (2006.01)

(52) U.S. Cl. ..... 399/91; 399/92; 399/98

(58) Field of Classification Search ..... 399/91, 399/92, 98, 99

See application file for complete search history.

(56) References Cited

U.S. PATENT DOCUMENTS

| | | | | |
|---|---|---|---|---|
| 4,114,557 | A | 9/1978 | De Brey | |
| 4,474,472 | A | 10/1984 | Winter | |
| 5,056,355 | A | 10/1991 | Hepher | |
| 6,628,907 | B2 * | 9/2003 | Dinca et al. | 399/98 |
| 2004/0259267 | A1 | 12/2004 | Gundel | |

FOREIGN PATENT DOCUMENTS

| | | | |
|---|---|---|---|
| DE | 2654736 | B1 | 12/1976 |

* cited by examiner

*Primary Examiner*—William J Royer
(74) *Attorney, Agent, or Firm*—Law Office of Charles W. Peterson, Jr.; Dale M. Crockatt

(57) ABSTRACT

An printer, such as a state of the art a high performance, electro-photographic printer. The printer includes at least one smart material sensor enclosed in the printer enclosure that monitors for the presence of a contaminant (e.g., toner or developer) above a selected threshold. Each smart material sensor is coupled to a control unit by a sensor driver coupling. When a smart material sensor finds that a contaminant is present the control unit may indicate the finding on a printer display and/or change operating mode.

20 Claims, 2 Drawing Sheets

PRINTER DYNAMICALLY MONITORING PRINTER ENVIRONMENT CONTAMINATION

BACKGROUND OF THE INVENTION

1. Field of the Invention

The present invention generally relates to printer maintenance and reliability and more particularly to reducing electro-photographic printer maintenance and improving electro-photographic printer reliability.

2. Background Description

Purchasing a state of the art electro-photographic printer may require a major investment from a business concern. To recoup that investment, the business concern may keep the electro-photographic printer running 24 hours a day, seven days a week. So, any time that the electro-photographic printer is not operating normally, the owner is losing money.

From time to time electro-photographic printers experience toner/developer handling mechanism failures. While some small level of toner is always present, e.g., passing through fine internal filters, these failures frequently allow significant toner to escape into the local environment, e.g., a printer room. While generally, developer does not escape from the printer as airborne particulates, it may spill or leak into the printer and surrounding areas. This fugitive toner/developer can contaminate the printer room and expose operators there to unhealthy levels of toner/developer particles. Cleanup from these fugitive toner/developer misadventures often requires large amounts of both time (i.e., down time) and labor. So in some cases, expensive external air filtration systems are installed, sometimes directly attached to the printer, to capture fugitive toner before it causes much damage. Thus, the expense dealing with fugitive toner particles and/or developer may be significant.

Although toner itself is expensive, fugitive toner itself does not usually damage the printer. However, fugitive toner in the paper path, for example, adheres to the paper as it traverses the path to degrade the print results. Fugitive toner also contaminates the printer optics and coronas, all of which makes print jobs look dirty at best and unreadable at worst and in either event unusable. This down-time may be further exacerbated by printer damage from developer contamination. Moreover, the presence of fugitive toner tends to shorten the life of cleaner brushes and filters, which shortens the maintenance cycle, adding to maintenance costs. So, much of the fugitive toner/developer particle contamination must also be cleaned from the printer itself as soon as it is detected. Usually, excessive dusting is an early warning of a problem, such as the failure of a seal or a toner charging problem, that warrants a service call.

Furthermore, in addition to print head optics being contaminated from fugitive toner and/or developer, contaminants that also originate external to the printer may also cause problems. Again with print head optics contaminated or dirty, regardless of the contaminant, the print results may be unusable as well and certainly do not look unprofessional.

Thus, there is a need to detect the occurrence of contaminants in state of the art printers and especially, fugitive emissions of toner/developer immediately, prior to their further escape into the printing environment.

SUMMARY OF THE INVENTION

It is therefore a purpose of the invention to reduce high performance printer down time.

It is another purpose of this invention to improve electro-photographic printer reliability.

It is yet another purpose of the invention to reduce electro-photographic printer operating and maintenance costs.

The present invention is related to a printer, such as a state of the art high performance electro-photographic printer. The printer includes at least one smart material sensor enclosed in the printer enclosure that monitors for the presence of a contaminant (e.g., toner or developer) above a selected threshold. Each smart material sensor is coupled to a control unit by a sensor driver coupling. When a smart material sensor finds that a contaminant is present the control unit may indicate the finding on a printer display and/or initiate/instigate action, e.g., change operating mode.

BRIEF DESCRIPTION OF THE DRAWINGS

The foregoing and other objects, aspects and advantages will be better understood from the following detailed description of a preferred embodiment of the invention with reference to the drawings, in which.

DESCRIPTION OF PREFERRED EMBODIMENTS

Figure 1:
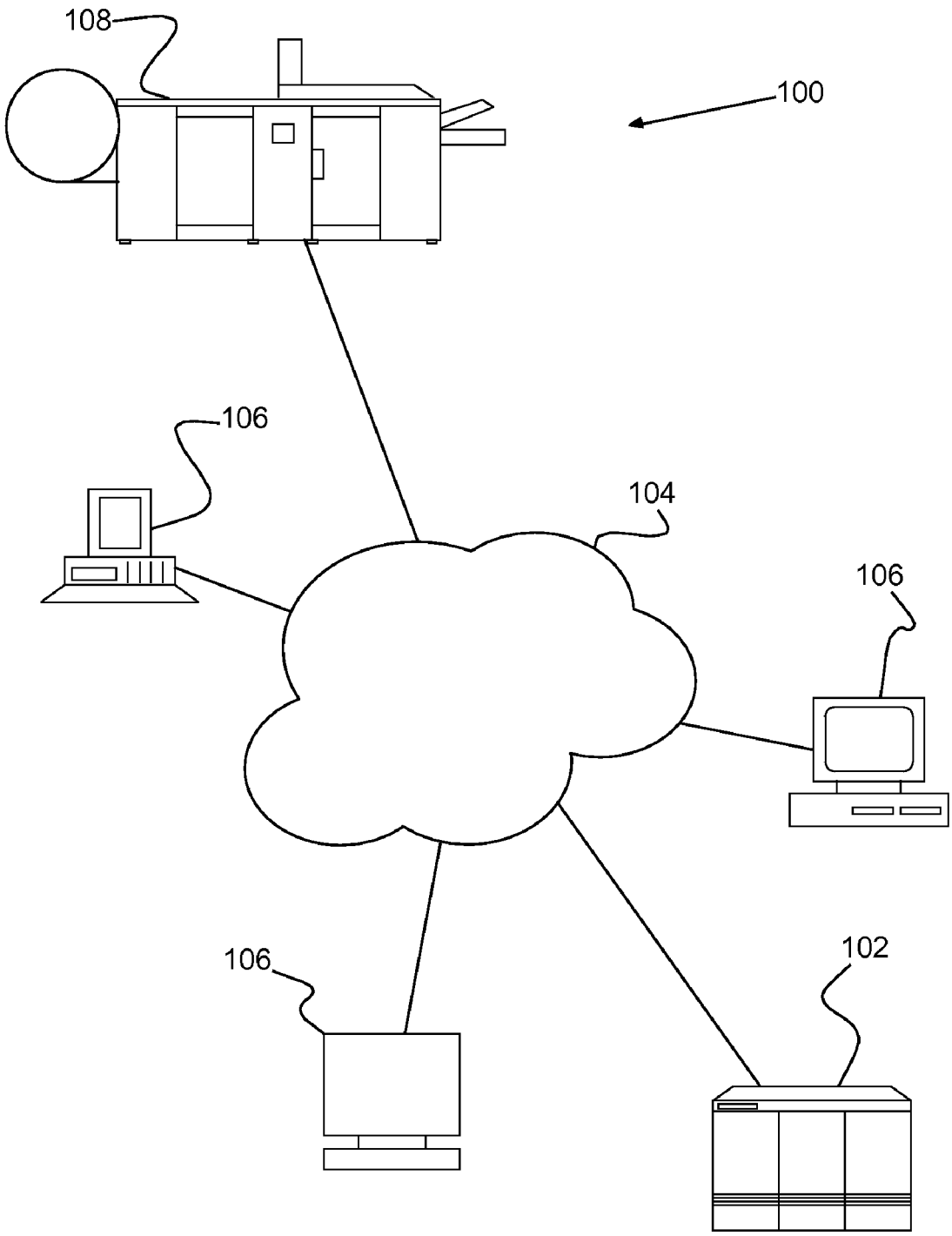
FIG. 1 shows an example of a self-monitoring electro-photographic printer dynamically monitoring for contamination (e.g., toner contamination) according to a preferred embodiment of the present invention.

Turning now to the drawings, and more particularly, FIG. 1 shows an example of a self-monitoring printer 100 dynamically monitoring for contamination (e.g., toner contamination) according to a preferred embodiment of the present invention. The printer 100 may be directly connected to one or more host systems 102, or, indirectly over a network 104 (wired or wireless). Also, remote terminals 106 (e.g., a personal computer (PC), a notebook or laptop computer, a personal digital assistant (PDA) or the like) may be connected to network 104 communicating with each other and the printer 100. Connected remote terminals 106 pass print jobs over the network 104 to the printer 100. Although described herein with reference to electro-photographic (EP) printers, and especially to high performance printers, this is for example only and not intended as a limitation. The present invention has application to ink jet printers, for example, where paper dust on ink jet heads can cause print quality problems and even early life failures. Similarly, ink jet head misadjustments can result in ink misting that contaminates printer components with errant ink. Thus, a preferred self monitoring ink jet printer monitors for ink leakage from distribution systems to provide an early warning. Thus, a preferred ink jet printer avoids cleanup problems as well as larger potential maintenance issues.

According to a preferred embodiment of the present invention, the printer 100 self-monitors its printing environment, e.g., the interior of the printer enclosure 108, for concentrations and/or aggregations of contaminant(s) above a selected threshold. The printer 100 may sense both internally originating contaminants such as fugitive toner and externally originating contaminants as well. Externally originating particulate contaminants include, for example, dust, paper dust and other airborne contaminants, that may be drawn into the printer enclosure 108, accumulate on internal printer surfaces and interfere with printer operation. So, the printer 100 may self-monitor air flows, for example, from the printer transfer cavity exhaust fan, EP process and paper cooling exhaust, and internal to its drum cavity. Also, the printer 100 may self-monitor internal printer surfaces in areas including, for example, in gas laser areas, areas surrounding printer coronas and printer operation sensors. The presence of contaminants above the selected threshold in the printer enclosure 108 identifies what may be an impending failure, e.g., of the toner/developer handling mechanism. So, by identifying impending failures, the printer 100 can initiate/instigate action to address the source of the problem and avoid more serious problems.

Thus, the preferred printer 100 includes smart material sensors located appropriately to detect the onset of threatening levels of contaminants in the printer enclosure 108. Materials that have one or more properties that can be dramatically altered commonly referred to as smart materials. Typical such smart materials, include coatings or films of materials such as piezoelectric materials, magneto-rheostatic materials, and electro-rheostatic materials. Although normally the thickness of coating is determined by application, a typical coating is less than one millimeter (1 mm) thick. So for example, the preferred printer 100 may include a smart material sensor that responds (e.g., a thin film piezoelectric coating that responds with a measurable signal) to a given concentration of toner, e.g., in passing airflow or in dust collecting on it. According to a preferred embodiment of the present invention, upon detecting fugitive toner in a contamination that indicates an impending failure, the printer 100 may take action or instigate appropriate action.

Figure 2:
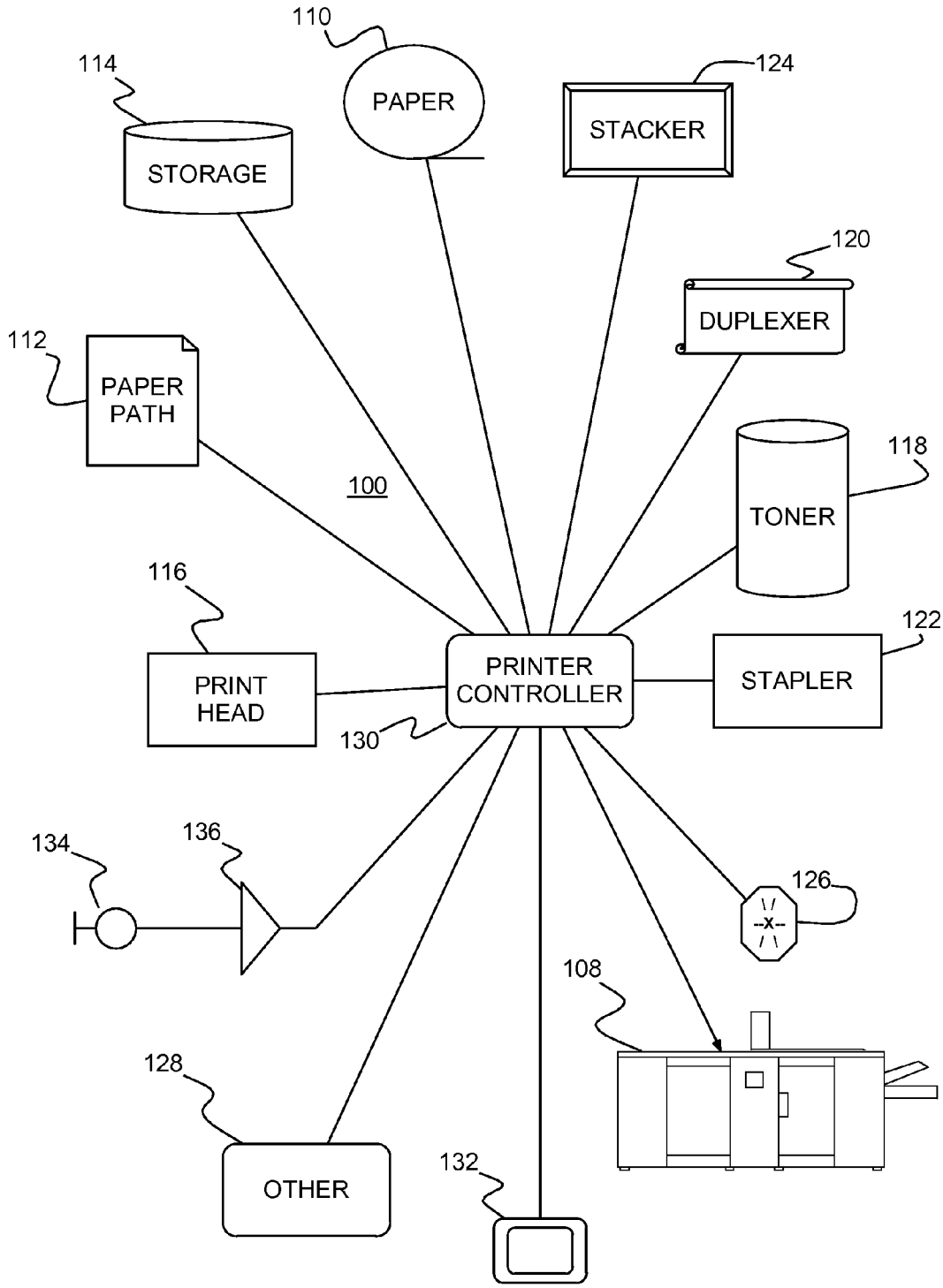
FIG. 2 shows a simple example of a preferred printer in more detail with representative printing environment.

FIG. 2 shows a simple example of a preferred printer 100 in more detail with representative printing environment, e.g., physical printer units enclosed in the printer enclosure 108. The printer units may include, for example, a paper feeder (e.g., paper in multiple paper trays or a paper roll) 110, a paper path 112, storage 114 (e.g., for a raw spool and a raster spool), a print head assembly (print head) 116, a toner reservoir (toner) 118, a duplexer 120, a stapler 122, a printed material repository (e.g., a stacker 124 or an output roll,), an exhaust fan 126 and a number of other physical locations 128. Other physical locations 128 may include, for example, the internal surface of the printer enclosure 108, a developer unit, a fixing or fusing unit ("fuser"), a paper transport (e.g., a tractor feed drive), a paper slicer and/or a finisher. It should be noted that these specific printer units 110, 112, 114, 116, 120, 122, 124, 126 and 128 are provided for example only and not intended as a limitation. Large printers, for example, are often roll fed with the output sliced on the fly or wound back into an output roll and moved to a finisher.

In addition, a preferred printer 100 also includes a control unit (print controller) 130 controlling and monitoring printer operation, a local display 132 and a smart material sensor 134. The smart material sensor 134 develops a signal in response to one or more particular type of contamination, e.g., toner. A sensor driver 136 connects the smart material sensor 134 to the control unit 130. An appropriate sensor driver or sensing electronics 136, such as are well known in the art, couple each smart material sensor 134 to the control unit 130. Further, although shown as a single smart material sensor 134, this is for example only. A preferred printer 100 may include multiple smart material sensors 134, each sensing for a different known contaminant(s) in the printing environment, e.g., the interior of the printer enclosure 108.

Thus, each smart material sensor 134 includes a suitable smart material that is sensitive to one or more particular known contaminants, such as for sensing abnormal toner/developer particle concentrations. The smart material sensors 134 are located for sensing internally and/or externally originating contaminants. For example, a sensor 134 may be chosen with a smart material suitable for sensing some particulate concentration level in a gas volume, e.g., of toner, developer or other printer contaminants. So, piezoelectric coatings or films may be applied to the blades of exhaust fans 126 or other surfaces exposed to high airflow. Further, other sensors 134 may be a smart material located at, or a smart material coating or film strategically applied to, an internal surface and at strategic locations, e.g., areas adjacent to toner/developer path seals.

So, the printer 100 may have individual sensors 134 and/or one or more fixed surfaces coated with smart material acting as sensors 134, such as, in areas adjacent to toner/developer paths and seals, e.g., at the toner reservoir 118 and the exhaust fan 126. Electro-photographic devices (e.g., print head assembly 116), for example, may be coated with smart materials, such as piezoelectric coatings or films. Once coated, these electro-photographic devices themselves act as surface sensors 134. These smart sensors 134 detect contaminants in levels that may indicate the onset of a failure, by signaling contamination levels that are characteristic of mechanical failures in the toner/developer handling systems. For example, a smart sensor 134 may detect problematic toner/developer contamination in printing areas.

Mating these sensors 134 with appropriate sensing electronics 136, allows both detecting an abnormal toner/developer particle concentrations in the exhaust stream, and also self-triggering corrective action mode or recovery mode within the printer 100. The sensor driver 136 may merely amplify smart material sensor signals. Alternately, the sensor driver 136 may develop a difference signal based on the response of the smart material sensor 134 to the contaminant level. The signals are passed to the control unit 130, which initiates/instigates corrective actions, e.g., reduces or shuts down the exhaust air stream, or sends a visual notification. The control unit 130 may provide a visual notification on local display 132 or, optionally, at a terminal, such as 106. For example, the control unit 130 may provide a message as a log entry or in a web based interface, send an e-mail to an operator or designated backup maintenance personnel, send text message alerts to a cell phone or initiate calls to a dispatch facility, or a system network focal point. Again, these examples are provided for example only and not intended as a limitation.

So, for example, where, the contaminant typically originates external to the printer 100, such as for print head optics multiple smart material sensors 134 may be used for monitoring for contaminants. So, one or more sensors 134 may monitor cooling air for the print head assembly 116, while others monitor the surfaces of the print head assembly 116 itself. When a particulate concentration aggregates on a surface monitored by one of the smart material sensors 134, the sensor driver 136 passes a signal to the control unit 130. Similarly, the airflow concentration at another of the smart material sensors 134 may develop a signal that the sensor driver 136 passes to the control unit 130. When any of the signals indicate, for example, that the particulate concentration in the cooling air is too high (above a threshold) or accumulated particulate count exceeds a cleaning threshold, the control unit 130 responds.

The control unit 130 may, for example, initiate corrective actions, e.g., to reduce or to shut down the exhaust air stream, or to send visual notification. This printer action may electronically annunciate the contaminant condition including, for example, initiating a call or e-mail for service. In a simple response, the printer 100 may force an interlock into a "service required" state. Alternately, for a more thorough printer control system response, the smart material responses may be integrated into the printer's autonomic systems. The smart material sensor signals combine with other printer control sensor signals (e.g., out of paper, low toner, door ajar) to provide feedback information and/or status information for readjusting printer operating points in real time to minimize contaminant impact. Such a readjustment, for example, may be done to minimize expulsion of fugitive toner (or emissions) while maximizing print/image quality.

So, in one embodiment, the smart material sensor 134 may be a simple particulate monitor monitoring airflow contaminant levels to/from the exhaust fan 126 or located to monitor airflow at the printer air intake. In another embodiment, the smart material sensor 134 may be applied to surfaces of internal element 110, 112, 114, 116, 118, 120, 122, 124, 126 and/or 128 monitoring particulate contamination as it collects on the surface. Electro-photographic devices (e.g., print head 116), for example, may have surfaces coated with smart materials. When the aggregate deposit exceeds a threshold contamination level on a specific surface, the sensing electronics 136 flags the control unit 130. For example, the control unit 130 may respond by generating a contamination warning and suggesting immediate action, or at least action as soon as possible, to avoid escalating problems.

In yet another embodiment, the smart material sensor 134 (or the sensing electronics 136) sums the toner particulate concentration over time. In this embodiment, when the cumulative contaminant load exceeds the threshold, the sensing electronics 136 flags the control unit 130. Again, the sensing electronics 136 flags the control unit 130 which responds, for example, by a contamination warning and suggests immediate action or at least action as soon as possible, to avoid escalating problems. So, because a preferred printer initiates/instigates an appropriate response before significant contaminant (e.g., toner/developer) levels develop, the printer 100 remains substantially contamination free.

It should be noted that although described herein with regard to a printer, this is for example only and not intended as a limitation. The present invention has application to monitoring any enclosed area for contamination, including for example, a PC 106 or surfaces in any boxed enclosure, where smart material sensors may be applied, e.g., as pollution sensors or early warning detectors. External environmental conditions that are hard on the internal printer mechanisms may be detected before the printer is contaminated. Alternatively, since surfaces generally reflect what is happening in the adjacent air volume; instead of using smart material sensors at a number of locations, a single instrumented fan with multiple inputs from around the system (internal and external locations) may be used.

Advantageously, with appropriate placement and integration of smart material sensors and sensor drivers within electro-photographic printing devices, printer failure causing contamination can be reduced or eliminated. Toner/developer contamination of printing areas, for example, may be prevented. The printer detects a level of fugitive toner contamination that indicates an impending failure, and takes early action or instigates appropriate early action, avoiding more serious problems. The smart material sensor signals combine with other printer control sensor signals (e.g., out of paper, low toner, door ajar) to provide feedback information and/or status information for readjusting printer operating points in real time to minimize contaminant impact. Such a readjustment, for example, may be done to minimize expulsion of fugitive toner (or emissions) while maximizing print/image quality.

Since contamination is minimized, the local environment (e.g., the printer room) and personnel (e.g., operators) are protected from contamination, e.g., from exposure to toner/developer particles. Further, because of early identification and avoidance, much of the clean up time and labor, that previously would have been expended remedially (e.g., removing fugitive toner/developer particles from the printing environment), also is avoided completely or, at least, dramatically reduced. This further reduces the associated down time, labor costs, and potentially detrimental health effects associated with clean up. Moreover, additional cost savings and in improved customer satisfaction may be realized in toner/developer, saved by correcting improper operation without waiting for a failure.

While the invention has been described in terms of preferred embodiments, those skilled in the art will recognize that the invention can be practiced with modification within the spirit and scope of the appended claims. It is intended that all such variations and modifications fall within the scope of the appended claims. Examples and drawings are, accordingly, to be regarded as illustrative rather than restrictive.

We claim:

1. A printer comprising:

a printer enclosure;

a control unit controlling print jobs being printed by said printer;

at least one smart material sensor enclosed in said printer enclosure and monitoring for the presence of a contaminant above a selected threshold; and a sensor driver coupling each said at least one smart material sensor to said control unit.

2. A printer as in claim 1, wherein said at least one smart material sensor comprises a piezoelectric sensor.

3. A printer as in claim 2, wherein at least one said piezoelectric sensor is a layer of piezoelectric material on an internal surface contained in said printer enclosure.

4. A printer as in claim 2, further comprising an exhaust fan maintaining an airflow through said printer enclosure.

5. A printer as in claim 4, wherein at least one said piezoelectric sensor is a layer of piezoelectric material on blades of said exhaust fan.

6. A printer as in claim 1, further comprising:

a display, said control unit indicating the presence of detected contaminant on said display.

7. A printer as in claim 1, further comprising:

a paper feeder;

a print head;

a printed material repository; and a paper path through said printer enclosure from said paper feeder to said print head and from said print head to said printed material repository, paper passing along said paper path from said paper feeder to said printed material repository.

8. A printer as in claim 7, wherein said printer is an electro-photographic printer, said print head is an electro-photographic print head and said at least one smart material sensor comprises a layer of piezoelectric material on said electro-photographic print head.

9. A printer as in claim 1, wherein said printer is an electro-photographic printer, said electro-photographic printer farther comprising:

a toner reservoir, said at least one smart material sensor monitoring for renegade toner in said printer enclosure.

10. An electro-photographic printer comprising:

a printer enclosure;

a paper feeder;

a print head;

a printed material repository;

a paper path through said printer enclosure from said paper feeder to said print head and from said print head to said printed material repository, paper passing along said paper path from said paper feeder to said printed material repository;

a control unit controlling print jobs being printed by said electro-photographic printer;

at least one smart material sensor enclosed in said printer enclosure and monitoring for the presence of a contaminant above a selected threshold;

a sensor driver coupling each said at least one smart material sensor to said control unit; and a display, said control unit indicating the presence of detected contaminant on said display responsive to a sensor signal from a respective said sensor driver.

11. An electro-photographic printer as in claim 10, wherein said at least one smart material sensor comprises a piezoelectric sensor.

12. An electro-photographic printer as in claim 11, wherein at least one said piezoelectric sensor is a layer of piezoelectric material on an internal surface contained in said printer enclosure.

13. An electro-photographic printer as in claim 12, further comprising an exhaust fan maintaining an air flow through said printer enclosure.

14. An electro-photographic printer as in claim 13, wherein said internal surface comprises blades of said exhaust fan.

15. An electro-photographic printer as in claim 12, wherein said print head is an electro-photographic print head and said internal surface comprises a surface of said electro-photographic print head.

16. An electro-photographic printer as in claim 11, further comprising:

a toner reservoir, said piezoelectric sensor monitoring for renegade toner in said printer enclosure.

17. An electro-photographic printer comprising:

a printer enclosure;

an exhaust fan maintaining an air flow through said printer enclosure;

a paper feeder, paper being loaded into said paper feeder;

a toner reservoir containing electro-photographic toner;

an electro-photographic print head fixing toner to page being printed;

a printed material repository receiving printed pages;

a paper path through said printer enclosure from said paper feeder to said electro-photographic print head and from said electro-photographic print head to said printed material repository, paper passing along said paper path from said paper feeder to said printed material repository;

a control unit controlling print jobs being printed by said electro-photographic printer;

one or more smart material sensor enclosed in said printer enclosure and monitoring for the presence of a contaminant above a selected threshold;

a sensor driver coupling each said one or more smart material sensor to said control unit; and a display, said control unit indicating the presence of detected contaminant on said display responsive to a sensor signal from a respective said sensor driver.

18. An electro-photographic printer as in claim 17, wherein said one or more smart material sensor comprises a layer of piezoelectric material on an internal surface contained in said printer enclosure.

19. An electro-photographic printer as in claim 18, wherein said internal surface comprises blades of said exhaust fan and a surface of said electro-photographic print head.

20. An electro-photographic printer as in claim 18, wherein said one or more smart material sensor comprises a piezoelectric material sensor monitoring for renegade toner in said printer enclosure and upon identifying renegade toner present, said control unit changes printer operating mode.

* * * * *